United States Patent [19]

Player

[11] 4,389,823

[45] Jun. 28, 1983

[54] MODULAR ROOF SKYLIGHT

[75] Inventor: Wayne H. Player, Mesquite, Tex.

[73] Assignee: Howmet Aluminum Corporation, New York, N.Y.

[21] Appl. No.: 275,640

[22] Filed: Jun. 28, 1981

[51] Int. Cl.[3] ..... E04B 7/18

[52] U.S. Cl. ..... 52/200; 52/463; 52/486

[58] Field of Search ..... 52/200, 459, 460, 463, 52/465, 486

[56] References Cited

U.S. PATENT DOCUMENTS

| | | | |
|---|---|---|---|
| 1,043,870 | 11/1912 | Royners | 52/465 |
| 3,307,309 | 3/1967 | Bloxsom | 52/465 |
| 4,045,932 | 9/1977 | Bogert | 52/460 |
| 4,155,206 | 5/1979 | Player | 52/486 |
| 4,192,113 | 3/1980 | Manlin, Jr. | 52/463 |

*Primary Examiner*—Peter M. Caun

*Attorney, Agent, or Firm*—Thomas L. Cantrell; Joseph H. Schley; Stanley R. Moore

[57] ABSTRACT

Disclosed is a modular roof skylight system which includes channel shaped roof and ceiling panel assemblies locked together with a skylight panel assembly therebetween. The skylight panel assembly includes roof and ceiling light transmitting sections which may be installed in place of and between modular roof panels. The inner ceiling skylight panel is securely mounted to the adjacent ceiling panels by a pair of flexible mounting clips complementally formed relative to elongated ceiling support strips secured to the adjacent ceiling panels. The support strips are formed with a plurality of serrations along one inner face. Each mounting clip is likewise formed with a plurality of mating ridges. A first of the mounting strips is secured on one side of the skylight panel opening with the serrations exposed for mating with a mounting clip. A second of the mounting strips is secured on an opposite side of the skylight opening with the serrations secured against the adjacent ceiling panel. In this manner only one side of the skylight panel is fixedly secured by the mounting clip serrations while the other side of the panel is releaseable by the removal of the mounting clip. This design facilitates ease in the removal of skylight panels while permitting these panels to be securely positioned in any desired area of the ceiling.

10 Claims, 7 Drawing Figures

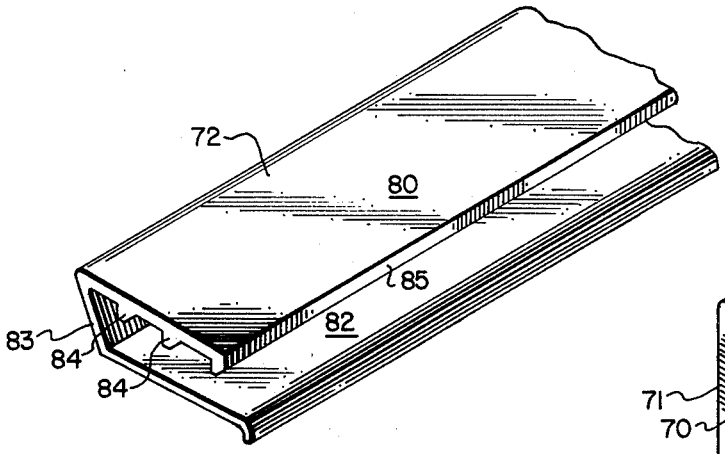
FIG. 3
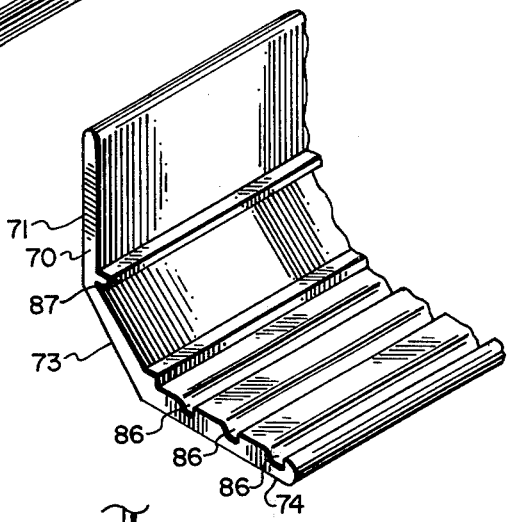
FIG. 4
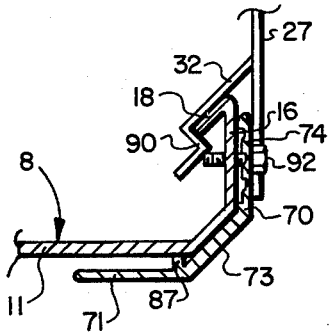
FIG. 5
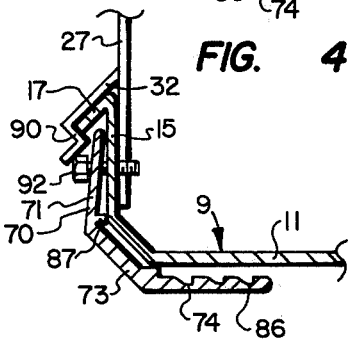
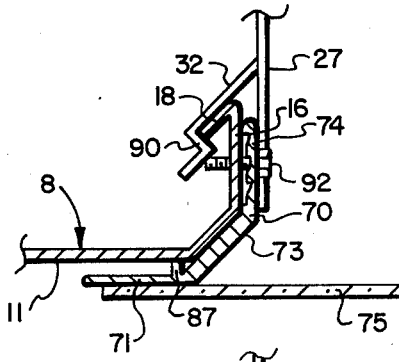
FIG. 6
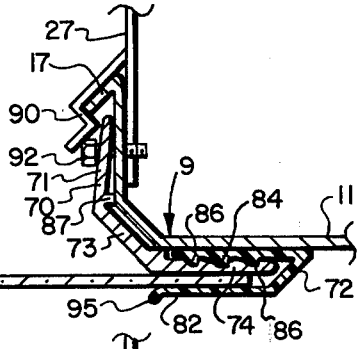
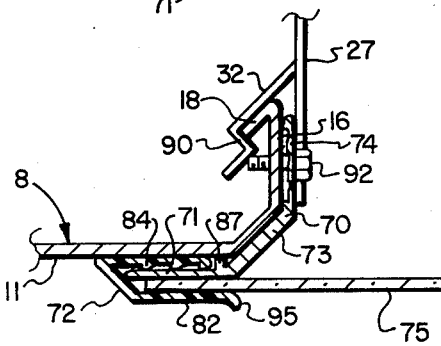
FIG. 7
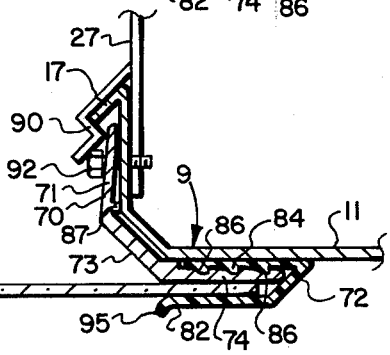

MODULAR ROOF SKYLIGHT

BACKGROUND OF THE INVENTION

Modular and/or multi-panel type roof systems have been shown to be particularly useful in "add-on" type construction projects. Such systems generally include an upstanding frame system in support of interlocking channel shaped roofing members. Suspension clips are generally attached to and depend from the roofing members with channel shaped ceiling members attached thereto. In the space below the roofing members, insulating material is often interposed. The modular roof members may include generally channel shaped roof and ceiling panels provided in an elongated configuration made of metal. Often edges of ceiling panels are formed to upstand and extend along the edges of adjacent panels. The roof sections are likewise preferably formed of sheet metal such as aluminum or steel with edges upstanding and integral with the base. The upper margin of the panel edges are often formed into interlocking joint elements, preferably of the kind in which two panels are interlocked one to the other. In this interlock position adjacent panels have their upstanding edges in a butting relationship. One such roofing panel system is shown and described in U.S. Pat. No. 4,155,206 issued to the assignee of the present invention.

Add-on rooms such as sun rooms of residential housing utilizing the aforesaid roofing system concepts have become very popular. Such systems have been shown to be economically feasible for increasing the livable space of houses which are otherwise of conventional construction. This is particularly true because of the simplicity of assembly, prefabrication aspects of construction, and ease of handling. Such aspects tend to hold down the otherwise high cost of such room construction. One disadvantage however of many prior art modular construction approaches is that luxuries such as skylights are difficult to selectively integrate into the system. This is due to the prefabricated aspect of the roofing design and necessity of uniform assembly methods. The additions of such skylights have been shown on occasion to be costlier when utilizing such roofing systems than with more conventional and rudimentary construction methods. In certain situations the use of modular roofing systems actually prevent the ecomonic installations of skylight panels preferred by the user.

Certain prior art modular roofing systems of the insulated variety have been designed for use with modular skylight assemblies. One such system is setforth and shown in U.S. Pat. No. 4,155,206, referred to above. The skylight panel described therein is comprised of an outer, skylight roof member, formed of polyvinylidene chloride resin or similar translucent material. The ceiling, or inner transparent panel is provided between adjacent insulated roof and ceiling sections and supported behind a pair of laterally extending support strips. The support strips are provided for locking engagement with the suspension clips utilized for support of the modular ceiling. While effective in supporting the inner skylight panel, the translucent panel itself is not rigidly secured within the ceiling structural network. Additionally, removal of the panel is only effected by raising and tilting it to one side and working it past the laterally extending support strip to allow it to be lowered into the room below. Such a method does not facilitate the maintenance and repair of the skylight, nor its installation.

It would be an advantage, therefore, to provide a skylight assembly in conjunction with a modular ceiling system which would overcome the disadvantages of certain prior art designs. Such an improved skylight panel is the subject of the present invention, wherein a pair of elongated mounting clips matingly engage a pair of ceiling mounting strips to support a ceiling skylight panel. In this manner the inner skylight section may be securely held in place in the ceiling while facilitating removeability for maintenance, installation and/or repair.

SUMMARY OF INVENTION

In accordance with the present invention, a skylight roofing system is provided which, in its preferred form, involves an interchangeable pair of ceiling mounting strips and a interchangeable pair of flexible mounting clips which are formed for complementally engaging laterally opposed edge portions of the ceiling skylight panel and the adjacent ceiling mounting strip for the securement of the ceiling panel. The preferred system thus includes a modular roof system having interlocking, channel shaped roof and ceiling members. Suspension clips are attached to and suspend ceiling panels from roof members. A skylight assembly is provided for positioning between adjacent roof sections and includes a pair of ceiling mounting strips, mounting clips, and a ceiling skylight panel for assembly to the adjacent ceiling members.

In yet another aspect, the invention includes a modular roofing structure and skylight assembly comprising channel shaped roofing panels having upstanding side legs with interlockable flanges formed at their upper ends. In this manner a series of panels are locked together in side by side relationship.

Channel shaped ceiling panels having upstanding side legs are also provided with interlockable flanges formed at their upper ends for interlocking a series of panels together in side by side relationships. Means then suspend the ceiling panels a selected distance beneath the roofing panels. A skylight roofing panel is disposed between the channel shaped roofing panels. The skylight panel is formed of light transmitting material and has locking means formed along the longitudinal edges, thereof for engagement with the interlocking flanges on the legs of the roofing members. A pair of elongated skylight ceiling panel mounting strips engage opposite sides of adjacent ceiling panel side walls and is secured thereto. The mounting strips each have first and second flanges aligned one to the other in generally orthogonal relationship.

A substantially planar skylight ceiling panel is formed out of light transmitting material and disposed beneath and in abutting engagement with the ceiling panel mounting strips, where a pair of elongated ceiling panel mounting clips matingly engage the outer edges of the ceiling panel and oppositely disposed flange portions of the mounting strips for securing the skylight ceiling panel.

In yet another aspect of the invention, the mounting strips and mounting clips each include mating serrations formed along opposing mating surfaces. The mating surfaces are aligned and interlocked on one side of the skylight ceiling panel to secure the assembly. On the opposite side of the skylight panel the mounting strip is secured in a reverse configuration to the adjacent channel shaped ceiling panel, thereby covering the serrations. In this manner, the mounting clip is not locked to the mounting strip by serration mating engagement. This feature of the assembly greatly facilitates installation and removal of the skylight panels while providing structural integrity in the mounting.

BRIEF DESCRIPTION OF THE DRAWINGS

For a more complete understanding of the present invention, and for further objects and advantages thereof, reference may now be had to the following description taken in conjunction with the accompaning drawings in which:

FIG. 3 is an enlarged, fragmentary, perspective view of one embodiment of the mounting clip of the present invention partially shown in FIG. 1;

FIG. 4 is a fragmentary enlarged perspective view of the ceiling mounting strip of the present invention partially shown in FIG. 1;

FIG. 5 is an end elevational, cross-sectional, fragmentary view of the skylight assembly of FIG. 1 with the ceiling skylight panel and mounting clips of the present invention removed;

FIG. 6 is the skylight panel of FIG. 5 with the ceiling skylight panel in place with the first of two mounting clips in position; and FIG. 7 is the skylight assembly of FIG. 6 with the ceiling skylight panel completly installed and both mounting clips in place.

DETAILED DESCRIPTION

Figure 1:
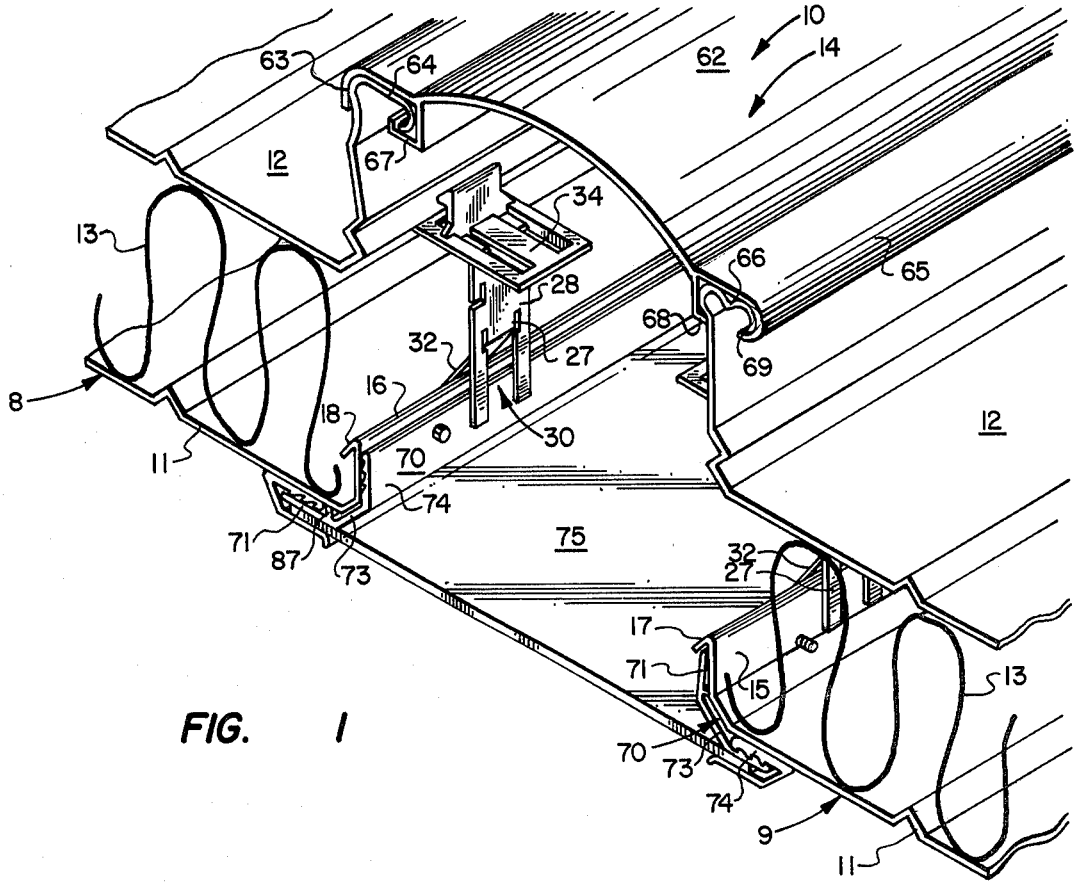
FIG. 1 is a fragmentary, cross-sectional perspective view of one embodiment of a skylight assembly constructed in accordance with principles of the present invention.

Attention is first directed to FIG. 1 where there is shown an improved, modular skylight system 10 having generally channel shaped roofing sections 8 and 9 assembled to lie in paralleled spaced relationship. Insulated 13 may be disposed within each roof section 8 and 9 for energy conservation. A skylight assembly 14 is provided for selective placement between any desired roof section 8 and 9 and may be secured thereto in place of similar non translucent roof panels. The assembly of modular roof and skylight sections is supported at its end by the walls of the structure being roofed, or by suitable transverse beams, neither of which are shown in FIG. 1. What is shown is a roofing system 10 herein illustrating a desirable improvement and flexability in skylight installation and maintenance. The assembly is installed in place of standard roofing section 8 and 9 with little additional effort. The specific construction of the skylight assembly 14 further affords full assembly compatability with the adjacent modular roofing panels as well as the accommodation of different thicknesses of insulation which may be necessitated by peculiarities of the specific roof configuration. Additionally as will be shown below the ceiling skylight assembly is provided in such a configuration as to provide improved securement of the ceiling skylight panel relative to roof sections 8 and 9.

Still referring to FIG. 1, each modular roof section 8 and 9 is identical to the other and includes an inner ceiling panel assembly 11 and outer roof panel assembly 12. The ceiling panels 11 are each provided with upstanding side edges comprising oppositely disposed side wall portions or legs 15 and 16. Space has prevented the full depiction of either identical roof sections 8 or 9 and consequently reference may be had to the opposite sides thereof depicted in FIG. 1. It may thus be seen that the left portion of the ceiling panel 11 of roof section 9 as viewed in FIG. 1, includes a curled flange 17 which curls outwardly of the leg 15 of the ceiling panel 11. Such a configuration is again, typical of the ceiling panel 11 of roof section 8 although not shown. The right hand side of ceiling panel 11 as shown in FIG. 1 includes a wall or leg portion 16 having an inwardly curled flange 18 entending therefrom. By this means, adjacent ones of panels 8 and 9 may be locked together in a side by side relationship with their upstanding legs 15 and 16 in a mating relationship of curled flange 17 abutting, engaging and curling around flange 18. The mating flanges 17 and 18 of adjacent panels are installed and interlocked together by rotating the particular panel 8 or 9 with respect to an already installed panel. Such a roofing method and apparatus is shown in copending U.S. patent application Ser. No. 6/275,656 filed June 22, 1981 assigned to the assignee of the present invention.

Figure 2:
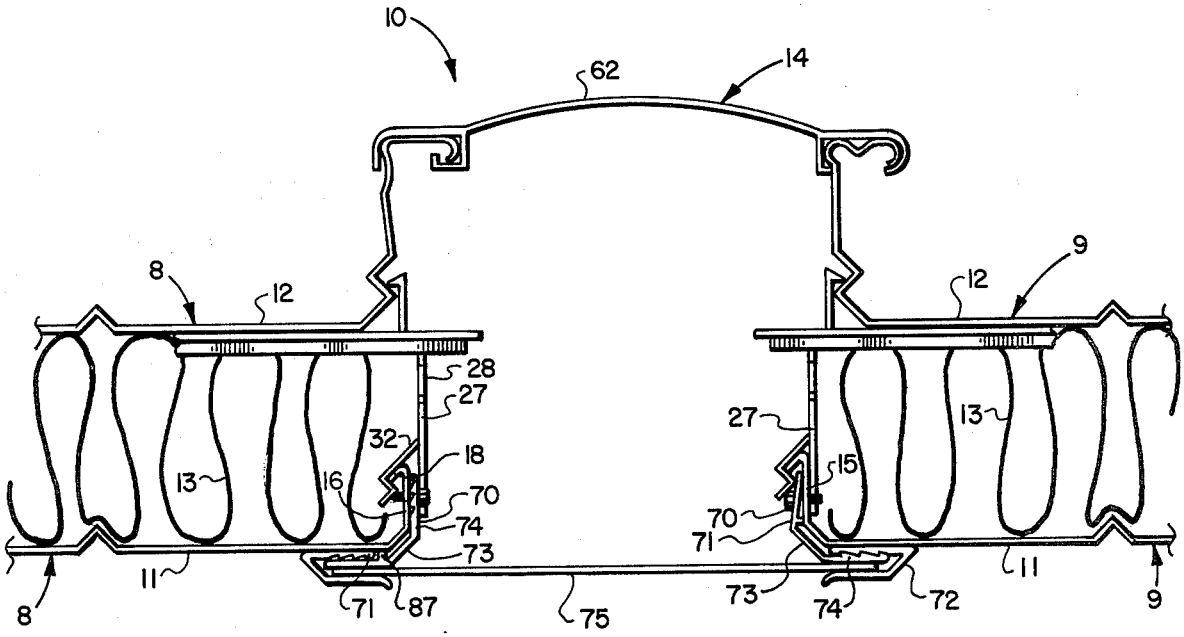
FIG. 2 is an end elevational cross-sectional view of the skylight assembly of FIG. 1.

Referring now to FIGS. 1 and 2 in combination the ceiling panels 8 and 9 each includes a roof panel assembly 12. The roof panel 12 is preferably supported by transverse beam or wall sections (not shown). The beam or wall section in support of the roof panel 12 is mounted for securing the position of said panels so as to permit them to support the underlying ceiling panels 11. A series of suspension clip members 27 are thus provided for support of the ceiling panel 11 by the upper roofing panel 12. The structure of clip 27 can be seen most clearly in FIG. 1 wherein a vertical element 28 is formed with an intermediate slotted portion 30 having an angular finger region 32 formed to complimentally engage the flange 18 of sidewall 16 of the panel 11. Similarly flange 17 of side wall 15 is coupled to clip 27. The clip 27 is suspended from and supported by transverse mounting elements 34 which complimentally engage the top portion of the clip 27. The structural formation and assembly configuration of the preferred embodiment of the clip 27 and roof sections 8 and 9 is set forth and described in more detail in copending U.S. patent application Ser. No. 4,155,206 assigned to the assignee of the present invention.

Referring specifically now to the skylight assembly 14 of FIGS. 1 and 2 there is shown one embodiment of the installation of skylight assembly in the modular roof configuration set forth above. The location for the skylight 14 is selected and a roofing section such as sections 8 and 9, is omitted from the side by side assembly. The omitted section is replaced by a series of skylight elements beginning with outer translucent roof panel 62 preferably formed of polyvinylide cloride resin, or some other suitable translucent or transparent material. Translucent member 62 is provided in place of roof panel assembly 12 and comprises an edge channel 63 for engaging a curled flange 64 of adjacent roof panel 12. A second edge channel 65 engages a mating curl flange 66 of roof panel 12 upstanding from roofing section 9. It can be seen that the channels 63 and 65 each have outwardly turned lips, 67 and 68, respectively, for engagement with the respective curl flanges 64 and 66. Channel 65 further has an outer, curled lip portion 69 for underlying engagement of the flange 66 as shown. In this manner the outer skylight member 62 is readily secured to the adjacent roof assemblies without modification thereto. The above set forth design utilizes the mating flange configurations of curl flanges 64 and 66 which are otherwise constructed for mating engagement one with the other.

Referring now to the ceiling portion of the skylight 14 of the present invention, a set of mounting strips and mounting clips are utilized to secure the ceiling skylight panel to the adjacent modular ceiling panels. For installation, the normal ceiling panel is omitted to make room for the skylight assembly 14. A pair of mounting strips 70 are provided for securement to adjacent legs 15 and 16. The strips 70 have a mating profile for engaging the edge portion 15 and 16 of the adjacent ceiling panels. The mating profile is comprised of a pair of generally orthogonal legs 71 and 74 which are joined through intermediate, angulated section 73. A light transmitting panel 75 is supported beneath the horizonally disposed legs of strip 70 by mounting clips 72. The securing mounting clip 72 is complimentally formed to receive the edge of the panel 75 and horizontal leg of the mounting strips 70. In this manner panel 75 is fixedly secured and yet can be easily installed and removed without bending and titlting of the panel as will be described in more detail below.

Referring now to FIG. 3 there is shown an enlarged, fragmentary view of the mounting clip 72 of the present invention. It may be seen that the clip 72 incorporates an elongated construction with a generally C-shaped cross-section and includes a first mounting portion 80, a lower support portion 82 and a beveled clamping region 83 therebetween. The clip 72 is preferably formed of a flexible material such as plastic or the like. The inner surface of the clip 72 includes elongated ridges 84 which in the shown embodiment, extend in generally parallel relationship with the outer edge 85 of the mounting portion 80. The ridges 84 may be seen to provide mating engagement with complementally formed serrations in the mounting strip 70.

Referring now to FIG. 4 there is shown enlarged, cross-sectional, perspective view of the mounting strip 70 of the present invention. A plurality of ridges or serrations 86 are provided in the inside surface of leg 74 of the strip 70. A mounting ridge 87 is likewise formed between the angulated portions 71 and 73. Strip 70 is preferably formed of aluminum or the like and may be extruded in the form shown herein. This particular configuration affords lateral and longitudinal rigidity.

Referring now to FIGS. 5, 6 and 7 in series, the method and apparatus of utilization of the clip 72 and strip 70 is shown in more detail. In FIG. 5 a fragmentary cross-section of the skylight panel 14 is shown with the ceiling panel 75 removed. It may be seen that the suspension clips 27 extend downwardly into engagement with the mounting strips 70. Tapered finger portion 32 of the clip 27 may be seen to include a Z-shaped end region 90 for snapping over and securing the end of flange portion 18 of wall portion 16 of ceiling panel 11. In like manner, flange 17 of leg 15 of the opposite panel 11 is also secured by clip 27, which is sufficiently versatile to accommodate various thicknesses. Clip 27 is thus designed to secure the ceiling panel 11 with or without the mounting strip 70 attached. As seen in FIG. 2, the mounting strip 70 is secured between clip 27 and leg 16 of section 8. In section 9, as shown, the support strip 70 is secured to the side wall portion 15 outside the clip 27.

Mounting strip 70 is secured to the side walls or legs of panel 11 by fastening members such as screws 90. The strip is formed to matingly engage the panels 11 adjacent the vertical leg or wall sections. The lower surface of the ceiling panel 11 of section 8 is engaged directly by the elongated rib 87 of the strip 70, which rib serves as a spacer to separate the leg 71 from the lower ceiling panel surface 11. In reverse manner, the rib 87 engages the side wall 15 of section 9. The serrations 86 of the strip 70 are thus exposed beneath section 9 and not exposed beneath roof section 8.

Still referring to FIG. 5 it may be seen that the strip 70 is conveniently interchangeable for use on opposite sides of the skylight assembly 14. Serrated portion 74 of the support strip 70 is, for example, disposed beneath ceiling panel 12 on the right side of the skylight assembly as compared to its covered position against the side wall portion 16 on the left side of the skylight assembly 14. This aspect of the invention facilitates installation and reduces cost.

Referring now to FIG. 6 there is shown the skylight ceiling panel 75 in position against the mounting strips 70. A right mounting clip 72 is shown installed beneath ceiling panel 11 of section 9. The serrations 86 of clip 72 matingly engages the ridges 84 of said clip and the ceiling panel 75 is wedged therebetween. It may be seen in this configuration that the clip 72 is permanently affixed to the skylight assembly shown herein, in that the mating engagement of the ridges and serrations, 84 and 86 respectively, prevent quick removal of said clip.

Referring now to FIG. 7, there is shown a cross-sectional view of the assembly of FIG. 6 with a left mounting clip 72 installed. The ridges 84 of the clip 72 may be seen to abut the inner surface of the leg portion 74 of strip 70 without engaging any portion thereof or affording any substantial resistance to the sliding movement of the clip 72 thereacross. In this manner, the clip 72 may be inserted and removed from the assembly for installation and removal of panel 75. The lower lip of the surface 82 of the support clip 72 may be seen to include a tapered lip portion 95 for facilitating the engagement of the clip 72 and the ceiling panel 75 during installation.

The skylight assembly 14 thus provides an improved method and apparatus for the skylight installation. The mounting clips and mounting strips 72 and 70, respectively, are conveniently interchangeable while affording secure mounting and ease in subsequent removal. Both installation and access to the skylight assembly 14 is thus provided in a configuration readily adaptable to the roofing system described above.

It is thus believed that the operation and construction of the present invention will be apparent from the foregoing description. While the apparatus as shown and described has been characterized as being preferred, it will be obvious that various changes and modifications may be made therein without departing from the spirit and scope of the invention as defined in the following claims.

What is claimed is:

1. A modular roofing structure and skylight assembly comprising:

channel shaped roofing panels having upstanding side legs with interlockable flanges formed at their upper ends for interlocking a series of panels together in side by side relationships;

channel shaped ceiling panels having upstanding side legs, with interlockable flanges formed at their upper ends for interlocking a series of panels together in side by side relationships;

means suspending said ceiling panels a selected distance beneath said roofing panels;

a skylight roofing panel disposed between said channel shaped roofing panels said skylight panel being formed of light transmitting material and having locking means formed along the longitudinal edges thereof for engagement with the interlocking flanges on the legs of said roofing members;

a pair of elongated skylight ceiling panel mounting strips each engaging opposite edge regions and side walls of adjacent ceiling panels and being secured thereto, said mounting strips each having first and second flanges aligned one to the other in generally orthogonal relationship;

a substantially planar skylight ceiling panel formed out of light transmitting material disposed beneath and in abutting engagement with said ceiling panel mounting strips; and a pair of elongated ceiling panel mounting clips matingly engaging the outer edges of said skylight ceiling panel and oppositely disposed flange portions of said mounting strips.

2. The apparatus as set forth in claim 1 wherein said mounting strips each include orthogonal flanges having a plurality of ridges formed on an inside surface of a first of said flanges and a generally smooth surface formed on an inside surface of a second of said flanges.

3. The apparatus as set forth in claim 2 wherein said mounting clips each include an elongated clamping element having a generally C-shaped cross section and a plurality of ridges formed on an inside surface of said clamping element.

4. The apparatus as set forth in claim 3 wherein a first of said mounting clips is secured to a first flange of one of said mounting strips by the mating engagement of said ridges of said mounting clip and mounting strip.

5. The apparatus as set forth in claim 4 wherein a second of said mounting clips is mounted upon a second flange of the other of said mounting strips with said ridges of said mounting clip abutting said generally smooth inside surface of said flange.

6. The apparatus as set forth in claim 1 wherein each of said mounting strips is formed with an intermediate angulated region connecting said first and second flanges, said first flange having a plurality of ridges formed on an inside surface and said second flange having a smooth inside surface with a stand-off adjacent said intermediate region for maintaining a select distance between said inside surface and said ceiling panel edge region disposed thereunder.

7. The apparatus as set forth in claim 1 wherein said mounting strips are secured to said ceiling panels with a plurality of threaded fastening members extending therethrough.

8. The apparatus as set forth in claim 1 wherein said skylight roofing panels and said skylight ceiling panels have a width substantially equivalent to the width of said channel shaped roofing panels and channel shaped ceiling panels, thereby establishing the alignability and placement of said skylight assembly between adjacent roofing panels.

9. The apparatus as set forth in claim 1, wherein said skylight roofing panels each include an arcuate cross-sectional configuration terminating along said locking means of said longitudinal edges, each of said locking means comprising pairs of opposed flanges formed for matingly engaging said interlockable flanges of adjacent channel shaped roofing panels.

10. An improved skylight assembly for a modular roofing structure of the type wherein channel shaped roofing and interior ceiling panels are formed and assembled with interlockable flanges along opposite sides thereof for mating engagement therebetween, and wherein a skylight roofing panel is disposed between at least two channel shaped roofing panels, said improvement comprising a skylight ceiling panel formed out of light transmitting material and being mounted to adjacent interior ceiling panels by a pair of elongated skylight ceiling panel mounting clips and mounting strips, said mounting strip having generally orthogonal flanges formed thereon with one of said flanges engaging an opposite edge region of a ceiling panel and being secured thereto, and each ceiling panel mounting clip matingly enaging the outer edges of said skylight ceiling panel and oppositely disposed flange portions of said mounting strips.

* * * * *